United States Patent [19]

Wilkerson

[11] Patent Number: 4,662,020

[45] Date of Patent: May 5, 1987

[54] COMBINED TRAILER AND VEHICLE BRIDGE

[76] Inventor: Jerry E. Wilkerson, P.O. Box 245, Rte. 1, Daleville, Miss. 37326

[21] Appl. No.: 786,637

[22] Filed: Oct. 11, 1985

[51] Int. Cl.[4] ..... E01D 15/12

[52] U.S. Cl. ..... 14/2.4; 14/72.5; 296/37.1; 296/182; 280/783

[58] Field of Search ..... 14/1, 2.4, 69.5, 70, 14/71.1, 72.5; 280/491 A, 783; 296/37.1, 181, 182; 293/117; 410/4, 7

[56] References Cited

U.S. PATENT DOCUMENTS

| | | | |
|---|---|---|---|
| 386,355 | 7/1888 | Shield | 14/69.5 |
| 1,289,392 | 12/1918 | Chervictnak | 14/2.4 |
| 2,130,418 | 9/1938 | DuPont et al. | 280/491 A X |
| 2,687,225 | 8/1954 | Martin | 14/2.4 X |
| 3,571,835 | 3/1971 | Buechler | 14/1 |
| 3,905,306 | 9/1975 | Janes | 280/491 A X |
| 4,015,858 | 4/1977 | Love | 296/182 X |
| 4,047,256 | 9/1977 | Hasara | 14/1 |
| 4,521,932 | 6/1985 | Parramore | 14/2.4 |

FOREIGN PATENT DOCUMENTS

| | | | |
|---|---|---|---|
| 355871 | 7/1922 | Fed. Rep. of Germany | 14/70 |
| 2141963 | 3/1973 | Fed. Rep. of Germany | 14/2.4 |
| 112972 | 6/1966 | Netherlands | 14/2.4 |
| 260572 | 3/1927 | United Kingdom | 296/37.1 |

*Primary Examiner*—Stephen J. Novosad
*Assistant Examiner*—John F. Letchford
*Attorney, Agent, or Firm*—Bacon & Thomas

[57] ABSTRACT

A combined trailer and vehicle bridge for detachable connection to a tow vehicle, the trailer being convertible to a bridge for spanning the opposite sides of a gulf in order to permit a vehicle to drive thereacross, including an elongate bed supported on a wheel assembly and provided with means extendable from either end of the bed on the opposite side of a gulf when the bed is being positioned thereacross by the tow vehicle.

10 Claims, 8 Drawing Figures

FIG 1
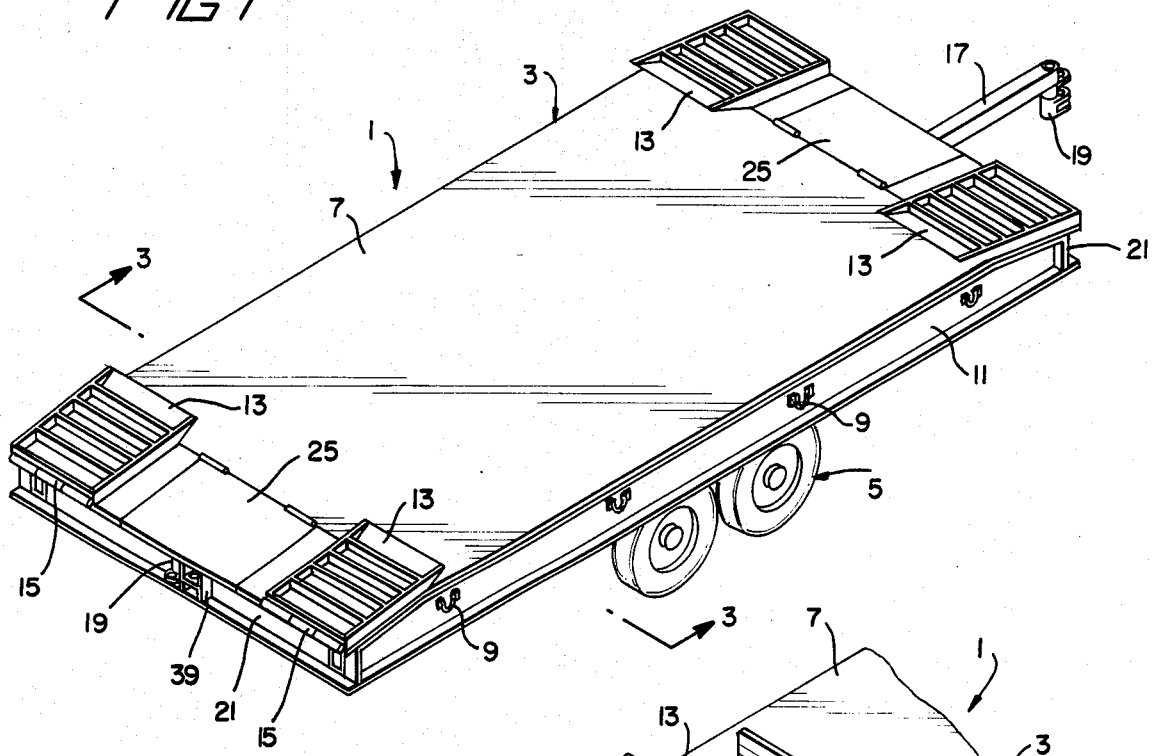
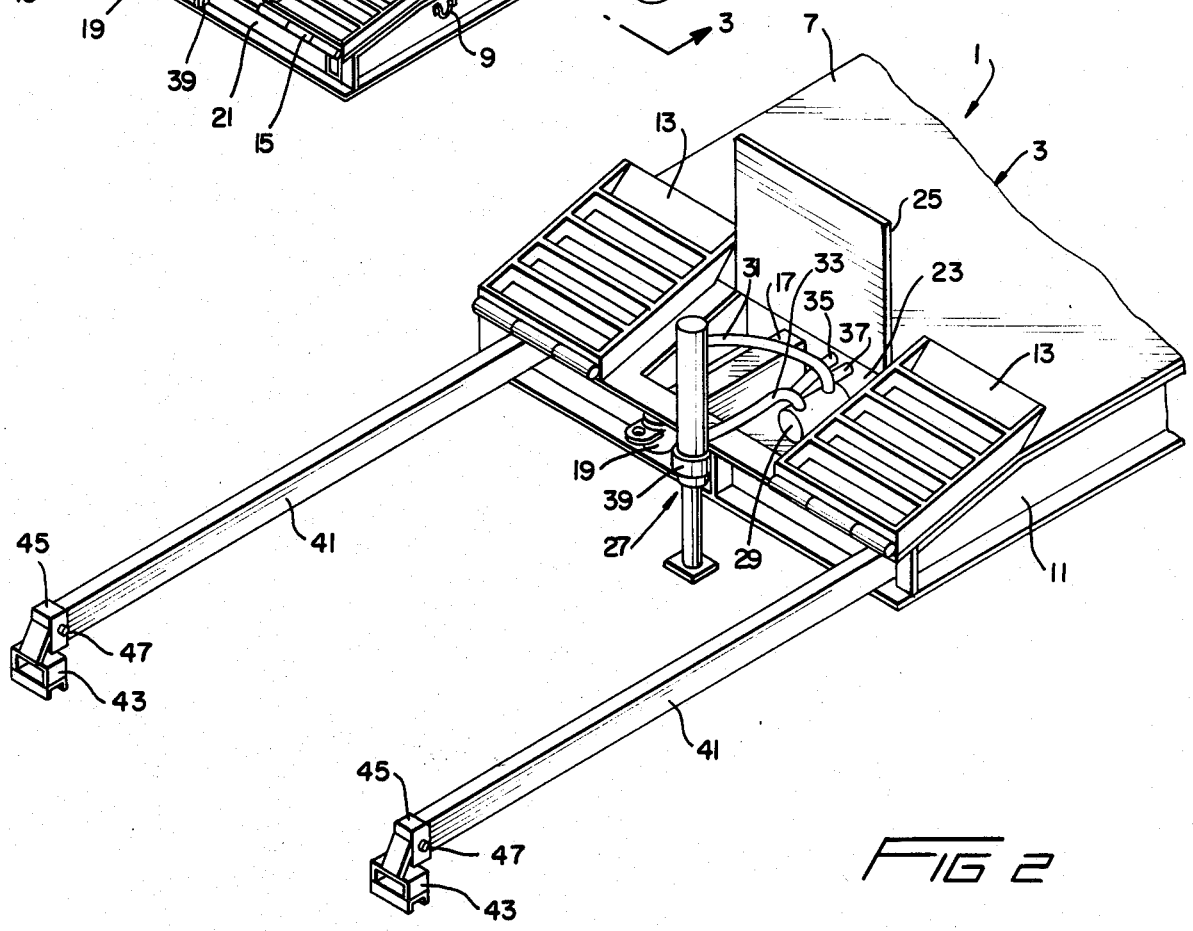
FIG 2

COMBINED TRAILER AND VEHICLE BRIDGE

BACKGROUND OF THE INVENTION

1. Field of the Invention

The present invention generally involves the field of technology pertaining to trailers which may be detachably connected to a tow vehicle. More specifically, the invention relates to an improved trailer which is also capable of being converted into a bridge for spanning the opposite sides of a gulf in order to permit a vehicle to drive thereacross.

2. Description of the Prior Art

It is known to provide a trailer or similar type of vehicle with provision for permitting a portion of the trailer to form a bridge spanning the opposite sides of a gulf so that vehicles may be driven thereacross. Known trailers of this type have been somewhat complex in structure and difficult to install during conversion from the trailer mode to the bridge mode. Known vehicles of this type have also been lacking in the ability to handle significant loading in both the trailer and bridge modes. Some examples of conventional teachings in this field of prior art are disclosed by the Chervictnak U.S. Pat. No. 1,289,392; Martin U.S. Pat. No. 2,687,225 and Buechler U.S. Pat. No. 3,571,835.

SUMMARY OF THE INVENTION

It is an object of the present invention to provide an improved trailer which is capable of being converted into a bridge for spanning the opposite sides of a gulf, such as a creek, stream, ditch, gully or the like.

It is another object of the invention to provide an improved combination trailer and vehicle bridge which is capable of transporting and supporting heavy loadings in both the trailer and bridge modes.

It is a further object of the invention to provide an improved trailer which can be easily and quickly converted into a bridge and reconverted into a trailer with minimum effort.

It is yet another object of the invention to provide an improved combined trailer and vehicle bridge which is of simple construction and may be economically manufactured.

These and other objects of the invention are realized by providing a combined trailer and vehicle bridge defined by an elongate bed which is centrally supported by a wheel assembly and includes a retractable tongue at each end of the bed for detachable connection to a tow vehicle. The bed is also provided with a pair of longitudinal beams which are internally stored on opposite sides of the bed and are extendable from either end thereof. A jack may be detachably connected to either end of the bed for selectively raising and lowering same. Each end of the bed includes a pair of retractable ramps which are disposed in an operative position when the bed is placed in the bridge mode, thereby permitting vehicles to be driven on and off the bed. The ends of the beams are further provided with removable ground engaging pads which support the beams in a stationary position to provide horizontal support for the bed during its conversion from the trailer mode to the bridge mode.

These and other objects, features and advantages of the invention shall become apparent from the following detailed description of the preferred embodiment thereof, with reference to the accompanying drawings which form a part of the specification, wherein like reference characters designate corresponding parts of the several views.

BRIEF DESCRIPTION OF THE DRAWINGS

FIG. 1 is a perspective drawing showing a combined trailer and vehicle bridge according to a preferred embodiment of the invention and disposed in a trailer mode with all ramps being in their retracted positions and one tongue being extended for attachment to a tow vehicle;

FIG. 2 is a partial perspective view of the combined trailer and vehicle bridge of FIG. 1 showing the longitudinal beams being extended and the jack being disposed in an operative position during conversion from the trailer mode into the bridge mode.

DETAILED DESCRIPTION OF THE PREFERRED EMBODIMENT

Figure 3:
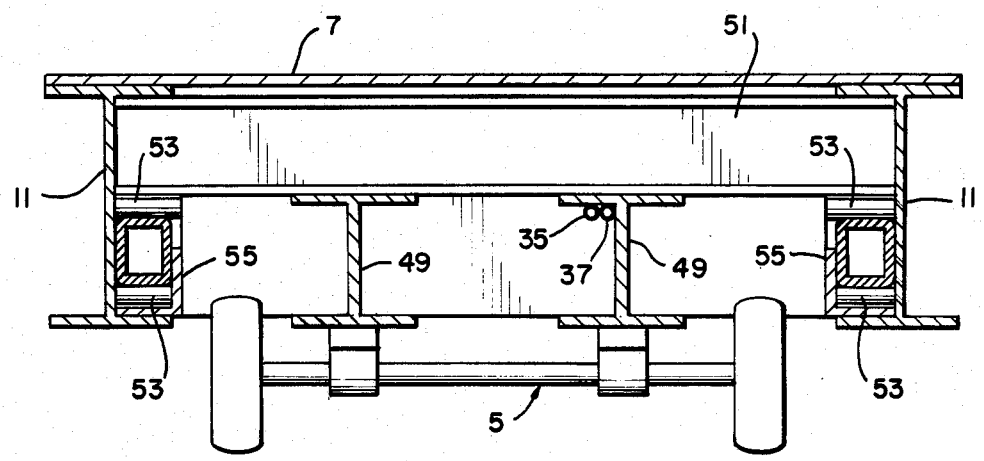
FIG. 3 is a cross-sectional view taken along the line 3—3 of FIG. 1.

A combined trailer and vehicle bridge 1 according to a preferred embodiment of the invention shall now be described with initial reference to FIG. 1. As shown therein, trailer 1 includes an elongate bed 3, of substantially rectangular configuration, supported for travel by means of a wheel assembly 5. It is preferred that wheel assembly 5 be disposed substantially midway between the opposite ends of bed 3, thereby supporting bed 3 centrally thereof. Bed 3 also includes an upper deck 7 of appropriate configuration so as to permit both the loading of cargo thereon and the traveling of wheeled vehicles thereacross. Both longitudinal sides of bed 3 may be provided with a plurality of spaced hooks 9 or similar devices for permitting cargo supported on deck 7 to be secured by means of ropes, cables or the like. It is further preferred that each longitudinal side of bed 3 be formed from a metal I-shaped beam 11. Deck 7 is preferably formed from a single or plural sheets of metal.

As also shown in FIG. 1, each end of bed 3 is provided with a pair of retractable ramps 13 and a retractable tongue 17. The end of each tongue 17 terminates in an appropriate coupling 19 which permits tongue 17 to be detachably connected to a corresponding coupling carried by a tow vehicle. Each end of bed 3 is also preferably formed from a metal beam 21 of appropriate cross-sectional configuration, such as channel-shape or I-shape. Each ramp 13 is pivotally connected to its corresponding end of bed 3 by a hinge 15, thus permitting ramps 13 to be pivoted outwardly and form extensions of deck 7 from either end of bed 3.

The end structure of bed 3 shall now be described in further detail with reference to FIG. 2. Though only one end of bed 3 is depicted therein, it is to be understood that the other end of bed 3 is of the same structural configuration. A storage compartment 23 that is closable by means of a pivotal cover 25 is provided at the end of bed 3 for storing a jack 27. It is preferred that jack 27 be of a hydraulic type and operated by a hydraulic pump 29 through a pair of fluid lines 31 and 33. Pump 29 may be powered by either its own independent battery or the existing battery carried by the tow vehicle. Pump 29 also includes a pair of fluid lines 35 and 37 which extend along the underside of bed 3 to the corresponding compartment at the other end thereof. Jack 27 is detachably connected to the end of bed 3 by means of a coupling 39 of any appropriate configuration, though preferably of the type affording quick connection and disconnection. Because of lines 35 and 37, a single jack 27 and a single pump 29 are all that is required for operating jack 27 at either end of bed 3. It is of course understood that jack 27, associated fluid lines 31, 33, 35 and 37, as well as all necessary connections and fittings therefor, may be of any type well known in the art and deemed suitable for the practice of the invention as described herein.

As further seen in FIG. 2, bed 3 is provided with a pair of longitudinal beams 41 which are telescopically received within bed 3 and stored therein on either side thereof. Beams 41 are preferably each formed of metal tubing having a rectangular-shaped cross-sectional configuration and being of sufficient strength so as to support the weight of trailer 1 from either end thereof in a manner to be later described. Beams 41 are each substantially the length of bed 3 and are extendable from either end thereof. When beams 41 are in the extended position as shown in FIG. 2, their terminal ends are provided with a pair of detachable ground engaging pads 43. Each pad 43 includes a box-shaped cap 45 which fits over the end of its corresponding beam 41 and secured in position by a pin 47. When not in use, pads 43 may also be stored within compartment 23.

The internal structure of bed 3 shall now be described with reference to FIG. 3. As shown therein, the basic supporting framework of bed 3 is defined by beams 11 which form the sides thereof. In addition, a pair of spaced internal I-shaped longitudinal beams 49 may also be provided. Internal support for deck 7 may be provided by a plurality of transverse braces 51 which are spaced along the length of bed 3. Each brace 51 is preferably formed from a metal beam having a channel-shaped cross-sectional configuration. Again, it is understood that the framework of bed 3 may be varied in any way well known in the art and deemed suitable for the practice of the invention as described herein.

As also shown in FIG. 3, each beam 41 is supported on either end of bed 3 by a pair of opposed rollers 53. An L-shaped metal angle beam 55 may be secured to each beam 11 for the purpose of defining a pair of longitudinal channels within which beams 41 are telescopically received and stored. In this way, beams 41 may be easily extended from either end of bed 3 with a minimum of frictional constraint.

MODE OF OPERATION

The manner in which the combined trailer and vehicle bridge of the invention is converted from the trailer mode into the bridge mode shall be sequentially described with reference to FIGS. 4–8.

Figure 4:
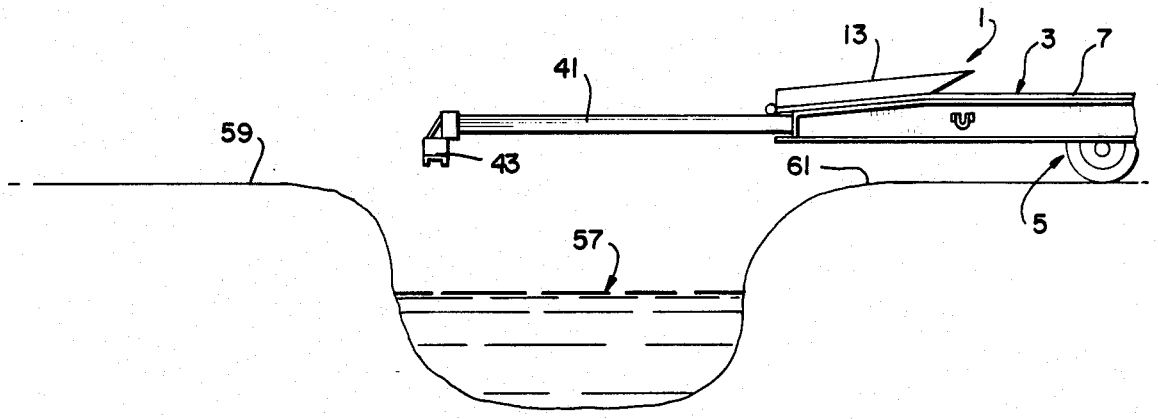
FIGS. 4–8 depict the sequential steps during conversion from the trailer mode to the bridge mode for spanning the opposite sides of a gulf.
Figure 5:
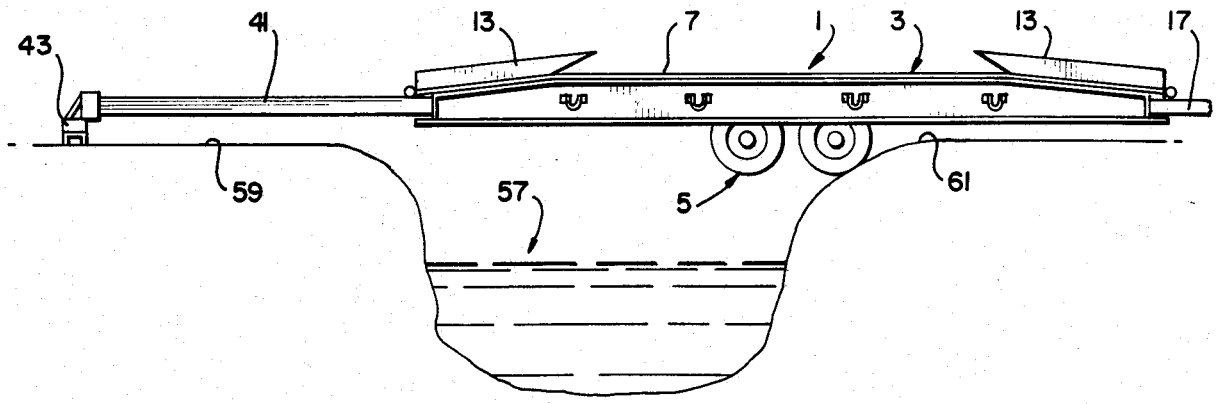

As seen in FIG. 4, trailer 1 has one end connected to a tow vehicle (not shown) which backs the other end of trailer 1 up to the edge of a gulf 57, in this case a stream, having a pair of opposite banks 59 and 61. Beams 41 have been extended from the end of bed 3 adjacent gulf 57 and are provided with ground engaging pads 43 at their terminal ends.

Trailer 1 is then backed towards bank 59 until pads 43 engage same, thereby maintaining beams 41 in a stationary position with respect to bed 3. Continued backing of trailer 1 causes beams 41 to be retracted within bed 3 and wheel assembly 5 to be disposed within gulf 57. The strength of beams 41 are such as to maintain trailer 1 in its horizontal position notwithstanding the lack of support normally realized through wheel assembly 5.

Figure 6:
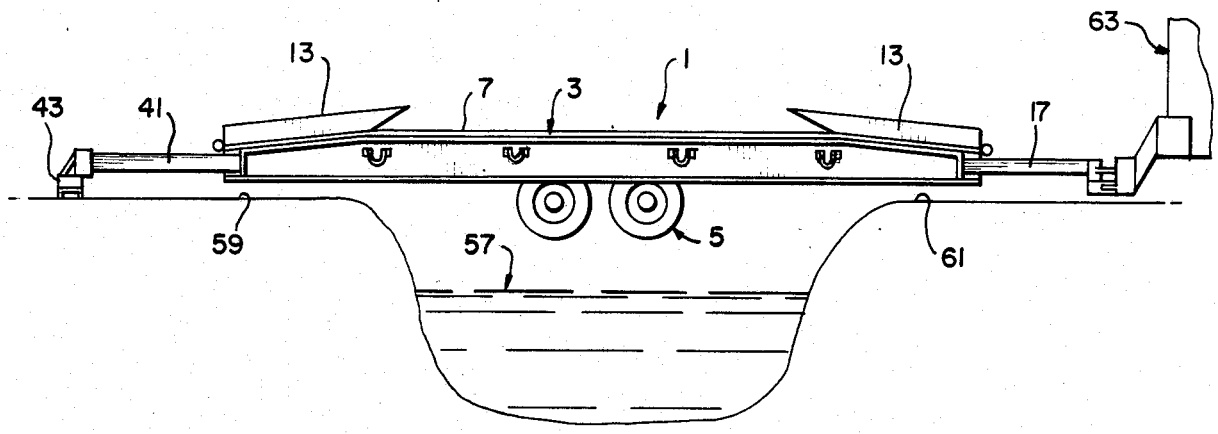

As shown in FIG. 6, trailer 1 has been disposed in a position wherein the ends thereof are directly positioned over banks 59 and 61, with wheel assembly 5 being disposed substantially midway therebetween. In this position, bed 3 is supported off of banks 59 and 61 by means of, respectively, beams 41 and tongue 17, the latter connected to a tow vehicle, generally designated at 63.

Figure 7:
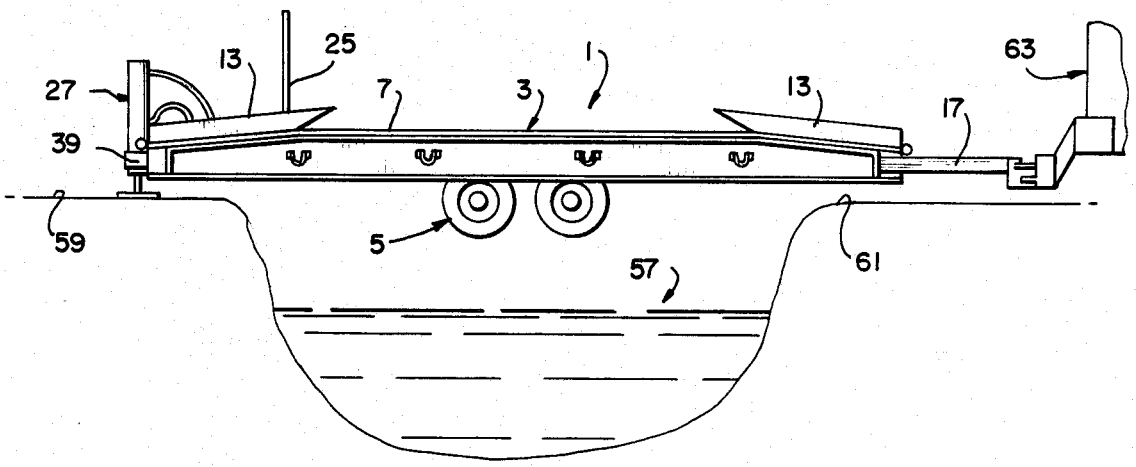

In the next stage as seen in FIG. 7, jack 27 is removed from compartment 23 and connected to coupling 39. Activation of jack 27 provides vertical lift and support for the end of bed 3 over bank 59, thereby permitting the retraction of beams 41 within bed 3. Thereafter, jack 27 can be activated to lower the corresponding end of bed 3 onto bank 59. Similarly, jack 27 is also utilized for providing vertical lift and support to the other end of bed 3 over bank 61 so that tongue 17 may be disconnected from tow vehicle 63 and retracted within bed 3. Thereafter, activation of jack 27 serves to lower the corresponding end of bed 3 onto bank 61.

Figure 8:
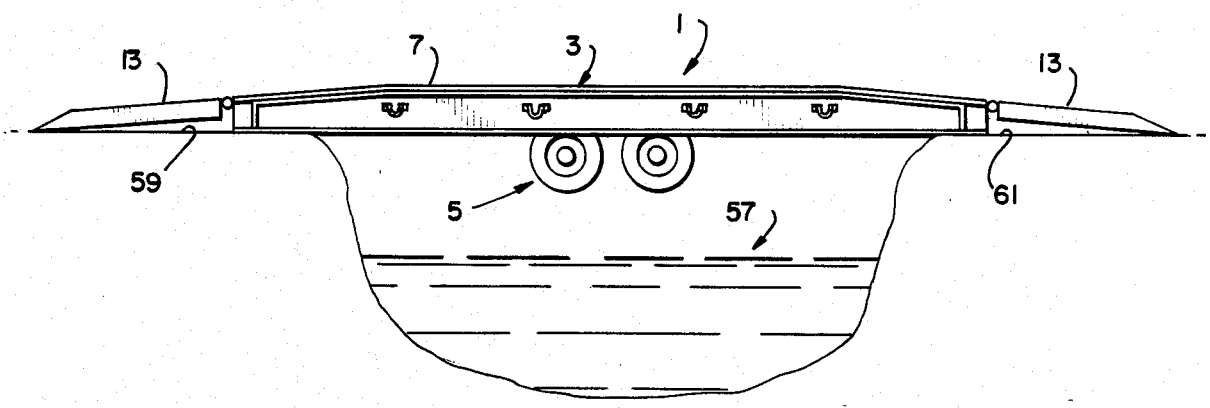

FIG. 8 depicts the completed conversion of trailer 1 to the bridge mode. As noted, ramps 13 have been pivoted outwardly onto banks 59 and 61, thereby forming extensions of deck 7 and thereby permitting vehicles, including tow vehicle 63, to cross over gulf 57.

The reconversion of the bridge mode shown in FIG. 8 back into the trailer mode shown in FIG. 1 is easily accomplished in substantially the reverse sequence. In this case, tow vehicle 63 shall be disposed on bank 59 and may be connected to tongue 17 associated with the corresponding end of bed 3. Beams 41 are extended outwardly over bank 61, thereby providing horizontal support for trailer 1 until when assembly 5 may be pulled by tow vehicle 63 onto bank 59. The raising and lowering of the opposite ends of bed 3 during extension and retraction of tongue 17 and beams 41 are accomplished through selective activation of jack 27 in the manner previously described.

It is to be understood that the form of the invention herein shown and described is to be taken as a preferred embodiment of the same, and that various changes in shape, material, size and arrangement of parts may be resorted to without departing from the spirit of the invention or scope of the subjoined claims.

I claim:

1. A combined trailer and vehicle bridge capable of being towed by a tow vehicle and spannable across the opposite banks of a gulf to permit a vehicle to drive thereacross, which combined trailer and vehicle bridge comprises:

(a) an elongate bed for conversion back and forth between a trailer and a bridge;

(b) wheel means supporting the bed midway between the ends thereof;

(c) connection means permitting either end of the bed to be detachably connected to a tow vehicle for travel as a trailer;

(d) support means extendable from either end of the bed for supporting each end of the bed on a corresponding bank of a gulf when the wheel assembly is disposed within the gulf;

(e) means carried at each end of the bed for lifting each end of the bed to permit connection or detachment of the connection means, and extension or retraction of the extendable means; and (f) the wheel means being always maintained midway between the ends of the bed during conversion of the bed between a trailer and a bridge.

2. The combined trailer and vehicle bridge of claim 1 further including means carried at each end of the bed for permitting a vehicle to drive onto and off of the bed.

3. The combined trailer and vehicle bridge of claim 2 wherein the means permitting a vehicle to drive onto and off of the bed includes a pair of ramps pivotally connected to each end of the bed for displacement between a retracted position wherein the ramps overlie the bed and an extended position wherein the ramps extend longitudinally from either end of the bed.

4. The combined trailer and vehicle bridge of claim 1 wherein the lifting means includes a fluid-operated jack.

5. The combined trailer and vehicle bridge of claim 1 wherein the extensible means includes a pair of beams which are longitudinally retractable within the bed and extendable from either end thereof.

6. The combined trailer and vehicle bridge of claim 5 further including ground engaging pads for detachable connection to the ends of the beams in their extended position.

7. The combined trailer and vehicle bridge of claim 5 further including rollers carried at each end of the bed and engageable by the beams for minimizing friction during retraction and extension of the beams.

8. The combined trailer and vehicle bridge of claim 1 wherein the enlongate bed includes a deck and the longitudinal sides of the bed further include means for securing cargo on the deck.

9. The combined trailer and vehicle bridge of claim 1 wherein each end of the elongate bed includes a storage compartment.

10. The combined trailer and vehicle bridge of claim 1 wherein the connection means includes a retractable tongue carried at each end of the bed.

* * * * *